US006011450A

United States Patent [19]

Miya

[11] Patent Number: 6,011,450

[45] Date of Patent: Jan. 4, 2000

[54] SEMICONDUCTOR SWITCH HAVING PLURAL RESONANCE CIRCUITS THEREWITH

[75] Inventor: Tatsuya Miya, Tokyo, Japan

[73] Assignee: NEC Corporation, Tokyo, Japan

[21] Appl. No.: 08/948,812

[22] Filed: Oct. 9, 1997

[30] Foreign Application Priority Data

Oct. 11, 1996 [JP] Japan ..... 8-268995

[51] Int. Cl.[7] ..... H01P 1/15

[52] U.S. Cl. ..... 333/103; 333/262

[58] Field of Search ..... 333/103, 104, 333/101, 262; 327/493, 495

[56] References Cited

U.S. PATENT DOCUMENTS 5,327,017 7/1994 Fischer et al. ..... 333/103 X

FOREIGN PATENT DOCUMENTS 41-6487 4/1941 Japan .
56-7526 1/1981 Japan .
6007526 1/1981 Japan ..... 327/493
5-95930 4/1993 Japan .
6-152361 5/1994 Japan .
7-74604 3/1995 Japan .
7-29901 6/1995 Japan .
7-312543 11/1995 Japan .

*Primary Examiner*—Benny Lee

[57] ABSTRACT

Disclosed is a semiconductor switch which has: a first resonance circuit which is composed so that a variable capacitance element and an inductor are in series connected and a series circuit composed of an inductor and a capacitor are in parallel connected to the variable capacitance element and the inductor, the first resonance circuit having one end connected to an input terminal and the other end connected to a first output terminal; a second resonance circuit which is composed like the first resonance circuit and is grounded to the first output terminal; a third resonance circuit which is composed like the first resonance circuit and is connected to the input terminal in parallel with the first resonance circuit, the third resonance circuit having a second output terminal on the reverse side of the input terminal; and a fourth resonance circuit which is composed like the first resonance circuit and is grounded to the second output terminal.

3 Claims, 3 Drawing Sheets

SEMICONDUCTOR SWITCH HAVING PLURAL RESONANCE CIRCUITS THEREWITH

FIELD OF THE INVENTION

This invention relates to a semiconductor switch, and more particularly to, a semiconductor switch used for a high-frequency signal, such as a transmitted or received signal in a mobile communication terminal equipment.

BACKGROUND OF THE INVENTION

As conventional semiconductor switches, a FET switch that uses a difference between a "on" resistivity and a "off" resistivity in a FET, and a PIN diode switch that uses a difference between a "on" resistivity and a "off" resistivity in a PIN diode are known. Both of these switches are using a difference between a "on" resistivity and a "off" resistivity in a semiconductor device.

The FET switch is popular with recent mobile communication terminal equipments because of its low consumed current and easiness of integration.

Here, the principle of FET switch operation will be explained in FIG. 1.

In FIG. 1, gates of FET 50 and FET 53 are connected through resistors 43, 46 to a control terminal 60, and gates of FET 51 and FET 52 are connected through resistors 44, 45 to a control terminal 61. The respective FETs maybe of the depletion type or enhancement type. Herein, depletion type of FETs are used.

A pinch-off voltage of the FETs 50, 51, 52, 53 is set to be $V_p$. When control voltages are applied namely, $V_{c1}=0V$, $V_{c2}<V_p$, where the voltage $V_{c1}$ is applied at the control terminal 60 and the voltage $V_{c2}$ is applied at the control terminal 61 capital "V" represents voltage and superscript lowercase "c" represents control voltage, FET 50 and FET 53 are turned on and FET 51 and FET 52 are turned off. In this case, drain-to-source resistivities of FET 50 and FET 53 become low and drain-to-source resistivities of FET 51 and FET 52 become high. Therefore, an input signal into an input terminal 1 is output from an output terminal 2.

On the contrary, when getting $V_{c1}<V_p$, $V_{c2}=0V$, drain-to-source resistivities of FET 50 and FET 53 become high and drain-to-source resistivities of FET 51 and FET 52 become low. Therefore, an input signal into the input terminal 1 is output from the output terminal 3.

FET 52 and FET 53 serve to improve the isolation of the output terminals 2 and 3. Namely, a leakage signal is dropped to ground by grounding to the turned-off terminal with the low resistivity.

As described above, by alternately switching the voltage $V_{c1}$ of the control terminal 60 and the voltage $V_{c2}$ of the control terminal 61, an input signal is output switching the output terminal 2 or 3. Meanwhile, 30, 31 and 32 in FIG. 1 are DC blocking capacitors.

However, the FET switch in FIG. 1 needs two control terminals, therefore complicating the control circuit composition.

To solve this problem, a PIN diode switch as shown in FIG. 2 has been suggested, where a difference between "on" and "off" resistivities of the PIN diode is used.

In the PIN diode switch, when a voltage is applied to a control terminal 4 so as to turn on PIN diodes 54, 55, both the PIN diodes 54, 55 have a low resistivity.

In this circuit, between the input terminal 1 and the PIN diode 54, a distributed constant transmission circuit(λ/4 transmission line 70) which have ¼ wavelength at a working frequency is connected. When the PIN diode 54 has a low resistivity, an impedance on the side of the PIN diode 54 becomes higher by viewing from the input terminal 1. Therefore, an input signal is output from the output terminal 3.

When a voltage is applied to the control terminal 4 so as to turn off the PIN diodes 54, 55, both the PIN diodes 54, 55 have a high resistivity. Therefore, an input signal is output from the output terminal 2.

Thus, the switch operation is conducted by using a resistivity difference between "on" and "off" of the PIN diodes and the λ/4 transmission line 70. Meanwhile, 30, 31 and 32 in FIG. 2 are DC blocking capacitors, and 40 and 47 are resistivities.

On the other hand, Japanese patent application laid-open No. 7-312543 (1995) discloses a conventional high-frequency switch circuit as shown in FIG. 3, where a varactor diode (variable capacitance diode) is used.

As shown in FIG. 3, the conventional high-frequency switch circuit is composed of a diode switch circuit including PIN diodes 56, 57 and resistors 40, 48 and 49, and a filter circuit including a varactor diode 58 and a capacitor 24. Meanwhile, in FIG. 3, 1 is an input terminal, 2 is an output terminal, 4 is a control voltage terminal and 33, 34 are DC blocking capacitors.

In this circuit, the varactor diode 58 is used only for a resonance circuit composing the filter circuit. Namely, the switching is, like the circuit in FIG. 2, conducted by using "on" and "off" resistivities of the PIN diodes 56, 57.

As described above, the FET switch in FIG. 1 needs two control terminals, therefore complicating the control circuit composition, and further it must have many terminals, therefore the size is difficult to reduce in case of its integration (First Problem).

Also, the PIN diode switch in FIG. 2 needs a certain amount of current to flow, therefore it is not suitable for mobile communication terminal equipments where lower consumed power is required (Second Problem).

Moreover, this switch uses, as shown in FIG. 2, the distributed constant transmission circuit(λ/4 transmission line 70), therefore increasing the entire area and size and giving a costly IC (Third Problem).

SUMMARY OF THE INVENTION

Accordingly, it is an object of the invention to provide a semiconductor switch which can give a miniaturized switch package and a simplified mobile communication device.

It is a further object of the invention to provide a semiconductor switch which is suitable for mobile communication terminal equipments where lower consumed power is required.

It is a still further object of the invention to provide a semiconductor switch which is suitable for integration.

According to the invention, a semiconductor switch, comprises:

a first resonance circuit which includes a variable capacitance element and an inductor connected in series and a series circuit composed of an inductor and a capacitor is connected in parallel to the variable capacitance element and the inductor, the first resonance circuit having one end connected to an input terminal and the other end connected to a first output terminal;

a second resonance circuit, which is composed like the first resonance circuit and is connected between ground and the first output terminal;

a third resonance circuit which is composed like the first resonance circuit and is connected between the input terminal and a second output terminal; and a fourth resonance circuit which is composed like the first resonance circuit and is connected between ground and the second output terminal.

BRIEF DESCRIPTION OF THE DRAWINGS

The invention will be explained in more detail in conjunction with the appended drawings, wherein.

DESCRIPTION OF THE PREFERRED EMBODIMENTS

First of all, a semiconductor switch of the invention is, as described earlier, composed using a capacity change in semiconductor device.

Figure 1:
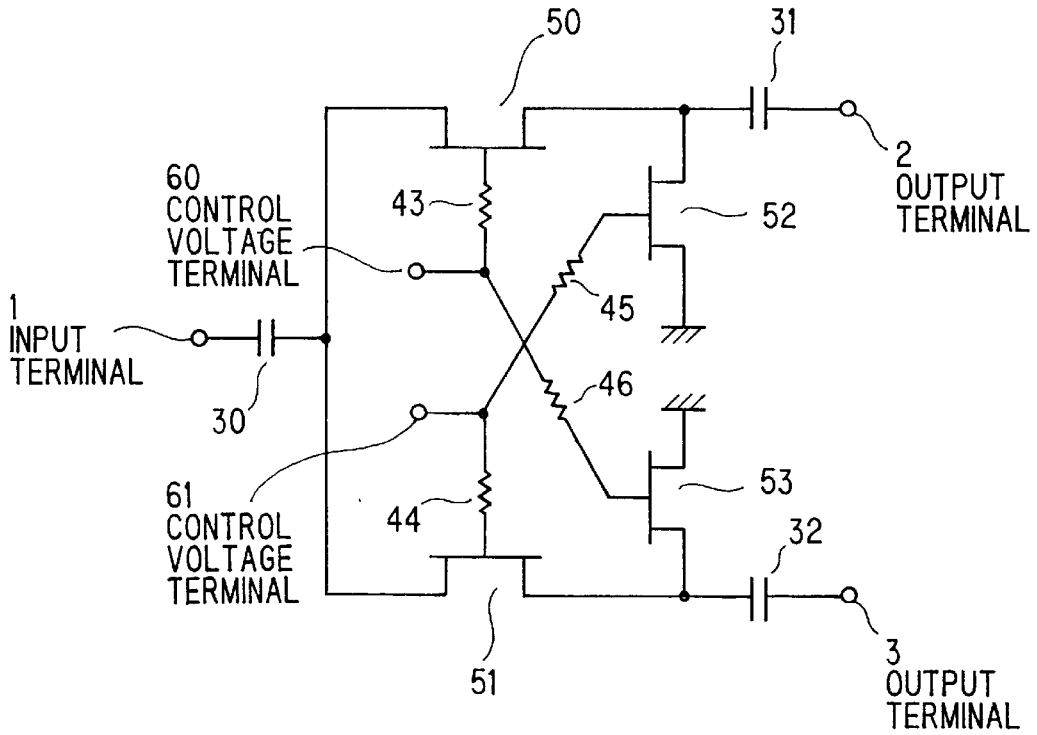
FIG. 1 PRIOR ART
FIG. 1 is a circuit diagram showing a conventional semiconductor switch (FET switch)
Figure 2:
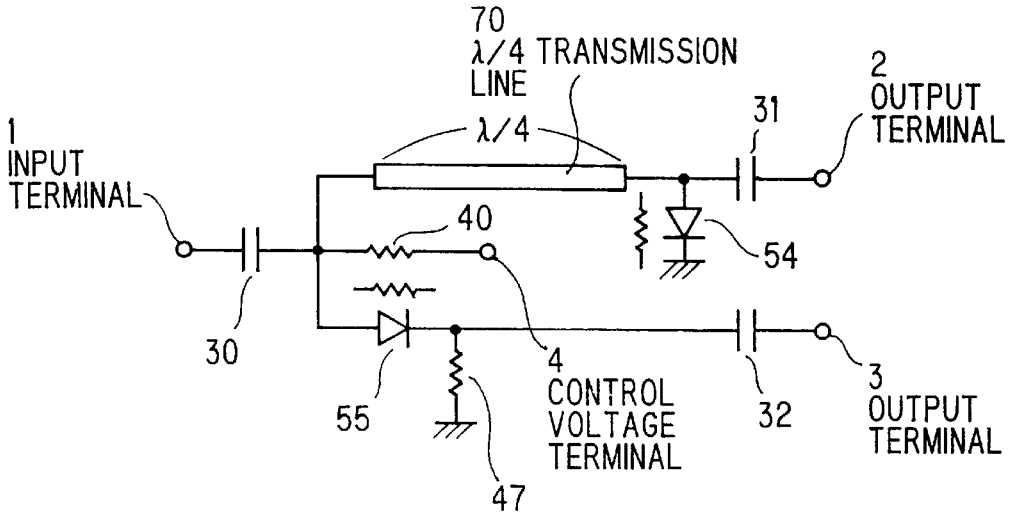
FIG. 2 PRIOR ART
FIG. 2 is a circuit diagram showing another conventional semiconductor switch (PIN diode switch)
Figure 3:
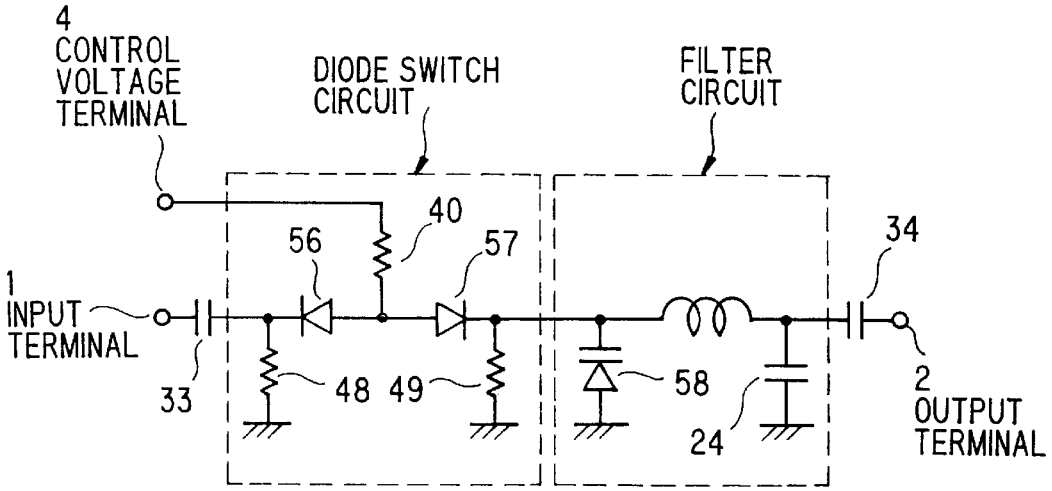
FIG. 3 PRIOR ART
FIG. 3 is a circuit diagram showing still another conventional semiconductor switch (varactor diode utilizing high-frequency switch)

Thus, the semiconductor switch of the invention can be provided with only one control terminal by using the capacity change in semiconductor device, without increasing the consumed current, while the conventional semiconductor switches in FIGS. 1 to 3 use a resistivity change in semiconductor device.

In the invention, due to the only one control terminal, semiconductor devices at a control voltage have the same states. In contrast with this, the conventional semiconductor switches using a resistivity change must use a distributed constant circuit so as to turn off (high resistivity) one of the semiconductor devices and turn on (low resistivity) the other.

In the invention, by using the capacity change, the switching operation can be conducted even with only one control terminal since a short-circuited state (low impedance) and an open-circuited state (high impedance) can be achieved even with the same capacity value by using parallel resonance and series resonance.

The semiconductor switch of the invention can be composed of only one control terminal by using a variable capacitance device, such as a varactor diode, while consuming no current itself and having no distributed constant circuit.

Furthermore, due to the only one control terminal, the switch device itself can be simplified since two kinds of control voltage circuits are not necessary.

Also, the semiconductor switch of the invention can have a reduced size and consumed power since an inverter circuit used typically is not necessary. Further, a small switch package can be achieved since the number of terminals can be reduced.

Furthermore, the semiconductor switch of the invention can have a reduced size, lower consumed power and cost since the switch itself needs no current and is provided with no distributed constant circuit.

Next, a semiconductor switch in the first preferred embodiment will be explained in FIG. 4.

Figure 4:
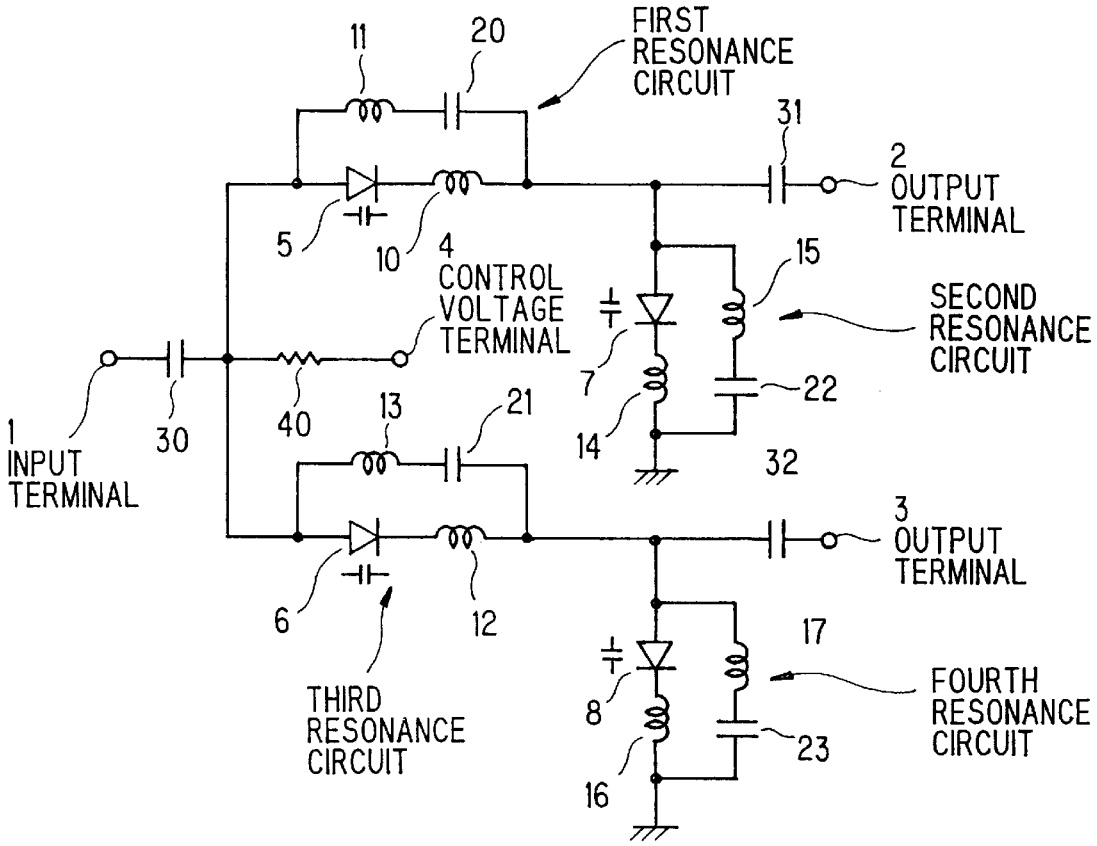
FIG. 4 is a circuit diagram showing a semiconductor switch in a first preferred embodiment according to the invention.

In FIG. 4, 1 is an input terminal, 2, 3 are output terminals, 4 is a control terminal ($V_c$=control voltage), 5 to 8 are varactor diodes, 10 to 17 are inductors (L), and 20 to 23 are capacitors (C).

As shown, the inductors 10, 12, 14 and 16 are in series connected to the varactor diodes 5, 6, 7, 8 respectively, and the inductors 11, 13, 15 and 17 and capacitors 20, 21, 22 and 23, respectively, in series connected are in parallel connected to the varactor diodes 5 to 8 and inductors 10, 12, 14 and 16. Also, each of first to fourth resonance circuits is composed of four elements, i.e., one varactor diode, two inductors and one capacitor.

Referring to FIG. 4, the first to fourth resonance circuits will be detailed below:

first resonance circuit: four elements of the varactor diode 5, two inductors 10, 11 and capacitor 20 second resonance circuit: four elements of the varactor diode 7, two inductors 14, 15 and capacitor 22 third resonance circuit: four elements of the varactor diode 6, two inductors 12, 13 and capacitor 21 fourth resonance circuit: four elements of the varactor diode 8, two inductors 16, 17 and capacitor 23.

Also, the semiconductor switch in the first embodiment is arranged so that:

1) one end of the first resonance circuit is connected to the input terminal 1, the other end is connected to the first output terminal 2 and the second resonance circuit is grounded to the first output terminal 2; and 2) one end of the third resonance circuit is connected to the input terminal 1 in parallel with the first resonance circuit, the other end of the third resonance circuit is connected to the second output terminal 3 and the fourth resonance circuit is grounded to the second output terminal 3.

In the first embodiment, when a voltage is applied to the control terminal 4, all the varactor diodes have a common capacity value.

Here, the varactor diodes have a capacity value of "$C_{B1}$" where C is the Capacitance and subscript B is the varactor when $V_C$–$V_{C1}$ where V is the voltage and subscript C is the control voltage is given, and they have a capacity value of "$C_{B2}$" when $V_C$=$V_{C2}$ is given. Parameters in the respective resonance circuits including the varactor diodes are determined as described below.

For example, the parameters of the inductor 10, capacitor 20 can be determined so that series resonance occurs when the capacity of the varactor diode 5 is "$C_{B1}$" and parallel resonance occurs when the capacity of the varactor diode 5 is "$C_{B2}$".

Namely, the parameter, inductance, of the inductor 10 (hereinafter referred to as "$L_{10}$") and the parameter, capacitance, of the capacitor 20 (hereinafter referred to as "$C_{20}$") are given by:

$$L_{10} = \frac{1}{(2\pi f)^2 C_{B1}} \tag{1}$$

$$C_{20} = \frac{1}{(2\pi f)^2 L_{11} - (C_{B1} - C_{B2})/C_{B1}C_{B2}} \tag{2}$$

In equations (1) and (2), $L_{10}$≈3 nH and $C_{20}$≈1.5 pF are obtained when f=2 GHz, $C_{B1}$=2 pF, $C_{B2}$=10 pF and $L_{11}$=2 nH Generally, "C" is the capacitance, "V" is the voltage, subscript "B" is the varactor, and subscript "c" is the control voltage.

Also, the inductance of the inductors 12, 13 can be determined so that parallel resonance occurs when the capacity of the varactor diode 6 is "$C_{B1}$" and series resonance occurs when the capacity of the varactor diode 6 is "$C_{B2}$".

Namely, the inductance of the inductor 12 (hereinafter referred to as "$L_{12}$") and the inductance of the inductance 13 (hereinafter referred to as "$L_{13}$") are given by:

$$L_{12} = \frac{1}{(2\pi f)^2 C_{B2}} \approx 0.6 \text{ nH} \tag{3}$$

$$L_{13} = \frac{1}{(2\pi f)^2} \cdot \frac{-C_{B1}C_{22} + C_{B2}C_{22} + C_{B2}C_{B1}}{C_{B1}C_{B2}C_{22}} \approx 3 \text{ nH} \tag{4}$$

where f=2 GHz, $C_{B1}$=2 pF, $C_{B2}$=10 pF and $C_{21}$=2 pF.

As described above, by using the common capacity values "$C_{B1}$", "$C_{B2}$", one circuit can switch from series resonance to parallel and the other circuit can switch from parallel resonance to series resonance.

Here, when $V_c=Q/C_{B1}$, where Q is charge is given, on the side of the output terminal 2, series resonance occurs and the high-frequency impedance becomes low, and, on the side of the output terminal 3, parallel resonance occurs and the high-frequency impedance becomes high. Thus, "passing" state on the side of the output terminal 2 and "breaking" state on the side of the output terminal 3 are obtained. Therefore, an input signal is output from the output terminal 2.

When $V_c=Q/C_{B2}$, where Q is charge is given, "breaking" state on the side of the output terminal 2 and "passing" state on the side of the output terminal 3 are obtained. Therefore, an input signal is output from the output terminal 3.

The second and fourth resonance circuits including the varactor diodes 7, 8, respectively, are set so that the inductors 14, 15 and capacitor 22 have the same values as those of the inductors 12, 13 and capacitor 21 and the inductors 16, 17 and capacitor 23 have the same values as those of the inductors 10, 11 and capacitor 20. Thereby, they operate in parallel resonance in the signal-passing state, or they operate in series resonance in the signal-breaking state. These, second and fourth resonance circuits can serve to improve the switch isolation characteristic like the conventional FET switch.

As explained above, it will be appreciated that the switching operation of the semiconductor switch circuit in the first embodiment can be conducted by using the only one control terminal.

Figure 5:
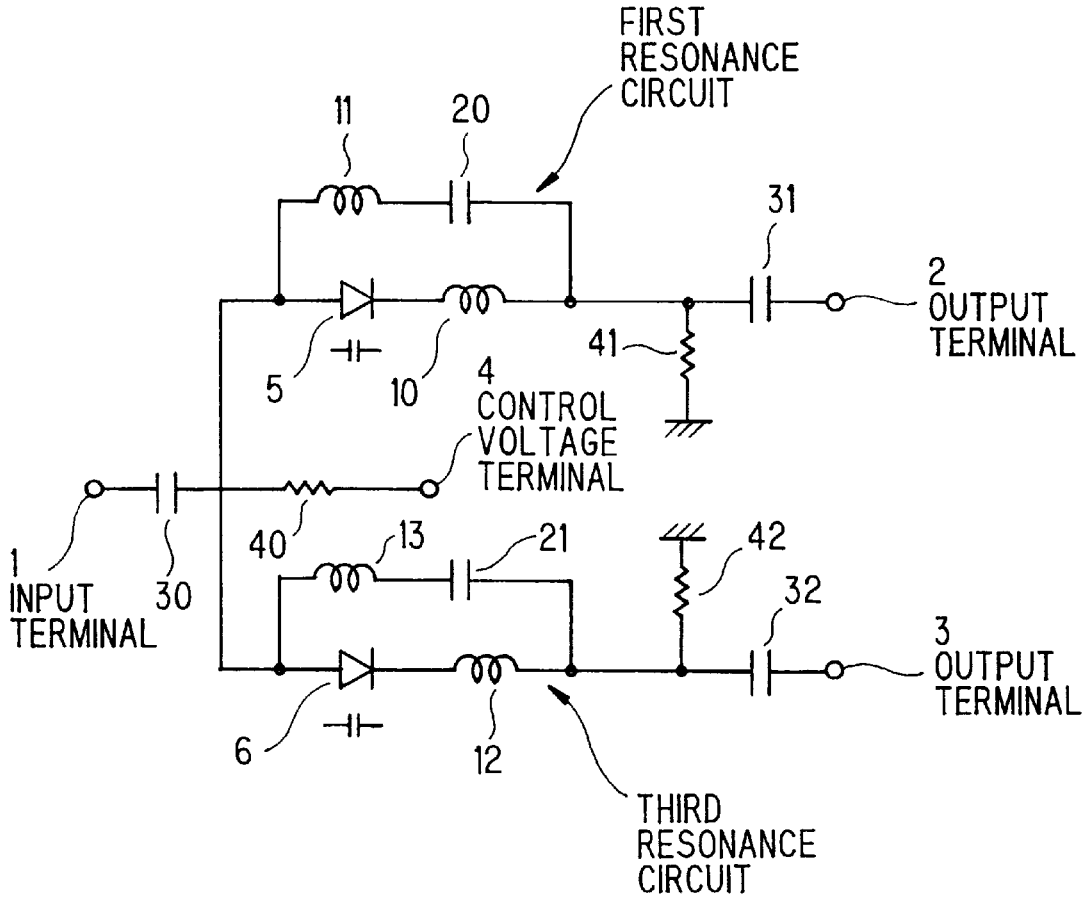
FIG. 5 is a circuit diagram showing a semiconductor switch in a second preferred embodiment according to the invention.

A semiconductor switch in the second preferred embodiment will be explained in FIG. 5.

The semiconductor switch in the second embodiment is composed omitting the second resonance circuit and the fourth resonance circuit in the first embodiment. Namely, the varactor diodes 7, 8, inductors 14, 15, 16 and 17 and capacitors 22, 23 in FIG. 4 are omitted therein.

In the second embodiment, resistors 41, 42 are disposed in place of the second and fourth resonance circuits in FIG. 4. The resistors 41, 42 have a high resistivity and compose DC return circuits.

Though the explanations as to the first and third resonance circuits in the second embodiment are omitted herein, they have the same elements and the same switch functions as those in the first embodiment.

In the first and second embodiments, the varactor diodes are used as an example of a variable capacitance element. Alternatively, a semiconductor switch according to the invention may be composed of a Schottky diode where the drain and source of FET are connected.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A semiconductor switch having an input terminal, a first output terminal and a second output terminal, comprising:

a plurality of resonance circuits, each said resonance circuit including (a) a respective variable capacitance element and a corresponding inductor connected in series and (b) a respective circuit composed of an inductor and a capacitor in series and connected in parallel with corresponding ones of said series variable capacitance element and said inductor, a first resonance circuit of said plurality of resonance circuits having one end thereof connected to said input terminal and another end thereof connected to said first output terminal;

a second resonance circuit of said plurality of resonance circuits being connected between a ground and said first output terminal;

a third resonance circuit of said plurality of resonance circuits being connected at one end thereof to said input terminal and at another end thereof connected to said second output terminal;

a fourth resonance circuit of said plurality of resonance circuits connected between said ground and said second output terminal;

wherein said first through fourth resonance circuits having respective resonance characteristics whereby a signal applied to said input terminal is selectably output at said first output at said first output terminal for first capacitance values of said respective variable capacitance elements and said signal is selectably output at said second output terminal for second capacitance values of said respective variable capacitance elements.

2. A semiconductor switch having an input terminal, a first output terminal and a second output terminal, comprising:

a plurality of resonance circuits, each said resonance circuits including (a) a respective variable capacitance element and a corresponding inductor connected in series and (b) a respective series circuit composed of an inductor and a capacitor in series and connected in parallel with corresponding ones of said series variable capacitance element and said inductor, a first resonance circuit of said plurality of resonance circuits having one end thereof connected to said input terminal and another end thereof connected to said first output terminal;

a second resonance circuit of said plurality of resonance circuits being connected at one end thereof to said input terminal and at another end thereof connected to said second output terminal; and said first and second resonance circuits having respective resonance characteristics whereby a signal applied to said input terminal is selectably output at said first output terminal for first capacitance values of said respective variable capacitance elements and said signal is selectably output at said second output terminal for second capacitance values of said respective variable capacitance elements.

3. A semiconductor switch as in claim 2, further comprising a first resistor connected between said first output terminal and a ground, and a second resistor connected between said second output terminal and said ground.

* * * * *